US005440180A

United States Patent [19]

DeVault et al.

[11] Patent Number: 5,440,180

[45] Date of Patent: Aug. 8, 1995

[54] MICROPROCESSOR BASED ELECTRICAL CONTACTOR WITH DISTRIBUTED CONTACTOR OPENING

[75] Inventors: Birch L. DeVault, Arden; Rick A. Hurley, Fletcher, both of N.C.

[73] Assignee: Eaton Corporation, Cleveland, Ohio

[21] Appl. No.: 952,242

[22] Filed: Sep. 28, 1992

[51] Int. Cl.[6] ..... H01H 9/56

[52] U.S. Cl. ..... 307/138; 361/166

[58] Field of Search ..... 307/137, 132 R, 132 E, 307/132 EA, 134, 132 M, 138; 361/3, 154, 166, 167, 168.1, 169.1, 185

[56] References Cited

U.S. PATENT DOCUMENTS 3,909,955 10/1975 Janke ..... 307/138 X
4,720,763 1/1988 Bauer .
4,769,737 9/1928 Ogita et al. ..... 361/203
4,833,284 5/1989 Park ..... 361/185 X
4,922,363 5/1990 Long et al. ..... 361/3
5,055,962 10/1991 Peterson et al. ..... 361/187

*Primary Examiner*—A. D. Pellinen
*Assistant Examiner*—Fritz M. Fleming
*Attorney, Agent, or Firm*—Martin J. Moran

[57] ABSTRACT

A multiphase contactor with solid state circuity gating rectified pulses to an electromagnetic coil to close and hold closed contacts for each phase, sequentially for each successive opening of the contactor adjusts the delay angle of the last pulse to rotate the sequence in which the individual phase currents are interrupted. By alternately making the last pulse positive or negative the polarity of the interrupted current alternates to further promote even contact wear.

13 Claims, 8 Drawing Sheets

MICROPROCESSOR BASED ELECTRICAL CONTACTOR WITH DISTRIBUTED CONTACTOR OPENING

CROSS REFERENCE TO RELATED APPLICATION

The subject matter of this invention is related to subject matter disclosed and claimed in the following commonly owned, co-pending, U.S. Ser. No. 07/636,000, filed Dec. 28, 1990, entitled "A PROCESS FOR AUTO CALIBRATION OF A MICROPROCESSOR BASED OVERCURRENT PROTECTIVE DEVICE AND APPARATUS".

BACKGROUND OF THE INVENTION

1. Field of the Invention

This invention is directed to electrical contactors, and particularly microprocessor based electrical contactors in which contactor opening is controlled with regard to the ac control voltage to vary the polarity, and in multiphase contactors, to also vary the phase sequence in which current is interrupted to thereby distribute contact wear.

2. Background Information:

Magnetic contactors are electrically operated switches used for controlling motors and other types of electrical loads. An example of such an electrical contactor is disclosed in U.S. Pat. No. 4,720,763. These magnetic contactors include a set of movable electrical contacts which are brought into contact with a set of fixed contacts to close the contactor. The contacts are biased open by a spring. The movable contacts are carried by the armature of an electromagnet. Energization of the electromagnet overcomes the spring forces and closes the contacts.

When a magnet contactor is operated by a manual push button, the opening process begins at the time of push button contact separation. There is a time delay between push button contact separation and the separation of the magnet and armature which hold the contactor closed. This delay time is a function of the magnitude of the supply voltage at push button contact separation, contact coil turns, coil resistance and coil inductance. Since the magnitude of the voltage is randomly selected by the operator of the push button, and the magnitude of the coil turns and inductance are constant and the coil resistance is approximately (varies with temperature) constant, the delay varies randomly within a range determined by the range of voltage that is available. After the delay time, opening time is a function of mechanical characteristics of the contactor including friction, spring force, and mass of the moving parts. These mechanical characteristics are considered to be constant. The total opening time is the sum of the delay time and the mechanical opening time.

When a magnetic contactor is operated by a solid state device, the operation is similar to a contactor operated by a manual push button except that the voltage applied to the coil at opening is constant due to the characteristic opening of solid state devices on a particular portion of the ac sine wave. Since all the parameters involved in contactor opening are constant, time for contactor opening is also constant.

It is well known that if an ac contactor repeatedly opens at the same point on the current wave form, its contact wear will be accelerated by a condition called material transfer. A small amount of contact material is always transferred from one contact face to the other during current interruption. The direction of material transfer is determined by the direction of current at the time of interruption. If the current, at the time of interruption is always the same, contact wear will be poor and will be evidenced by the creation of a valley on one contact face and a corresponding mountain on the other contact face. This is a common condition with dc contactors. This also occurs commonly with a solid state controlled ac contactors due to synchronism between the line voltage and the switching of the solid state device.

Another factor is involved in a three-phase magnetic contactor. Interruption of current on a three-phase circuit occurs at zero crossings. The current in the first phase to go through a zero crossing after contact separation will be interrupted first. The remaining two phases then form a single phase circuit. This single phase current in the remaining two phases will be interrupted at the next zero crossing of the single phase current. The first phase to interrupt does less work due to less arcing time than the other phases. Thus, if the first phase to interrupt current is always the same, the wear on the contacts will not be even.

A typical solution to the problem of contact wear in three-phase magnetic contactors is to use a drum switch or other device having random opening in place of a solid state control.

There is a need, therefore, for a means for evenly distributing contact wear on magnetic contactors operated by solid state control.

SUMMARY OF THE INVENTION

It is a primary object of the invention to provide a magnetic contactor with solid state control in which contact wear is evenly distributed.

More particularly, it is an object of the invention to provide such a magnetic contactor in which the first phase to open is evenly distributed over time.

It is a further object of the invention to provide such a magnetic contactor in which the polarity of the current at the time of current interruption is evenly divided over time.

These objects and others are realized by the invention which is directed to a magnetic contactor which includes coil energizing means gating pulses of ac voltage to an electromagnet through a solid state switch to close and hold closed separable contacts. The coil energizing means includes adjusting means adjusting on consecutive openings the point in the ac voltage at which the separable contacts open to thereby distribute wear over the separable contacts for each phase. This may be accomplished by selection of a random point over a period of the ac voltage, or preferably, by a preselected pattern which deterministically assures that the first phase to interrupt current is shared equally by each phase.

The adjusting means also assures that half of the current interruptions occur with current in each direction through each set of contacts. Again, this can be done randomly or by the preselected pattern.

DESCRIPTION OF THE DRAWING

A full understanding of the invention can be gained from the following description of the preferred embodiments when read in conjunction with the accompanying drawings in which.

DESCRIPTION OF THE PREFERRED EMBODIMENTS

Figure 1:
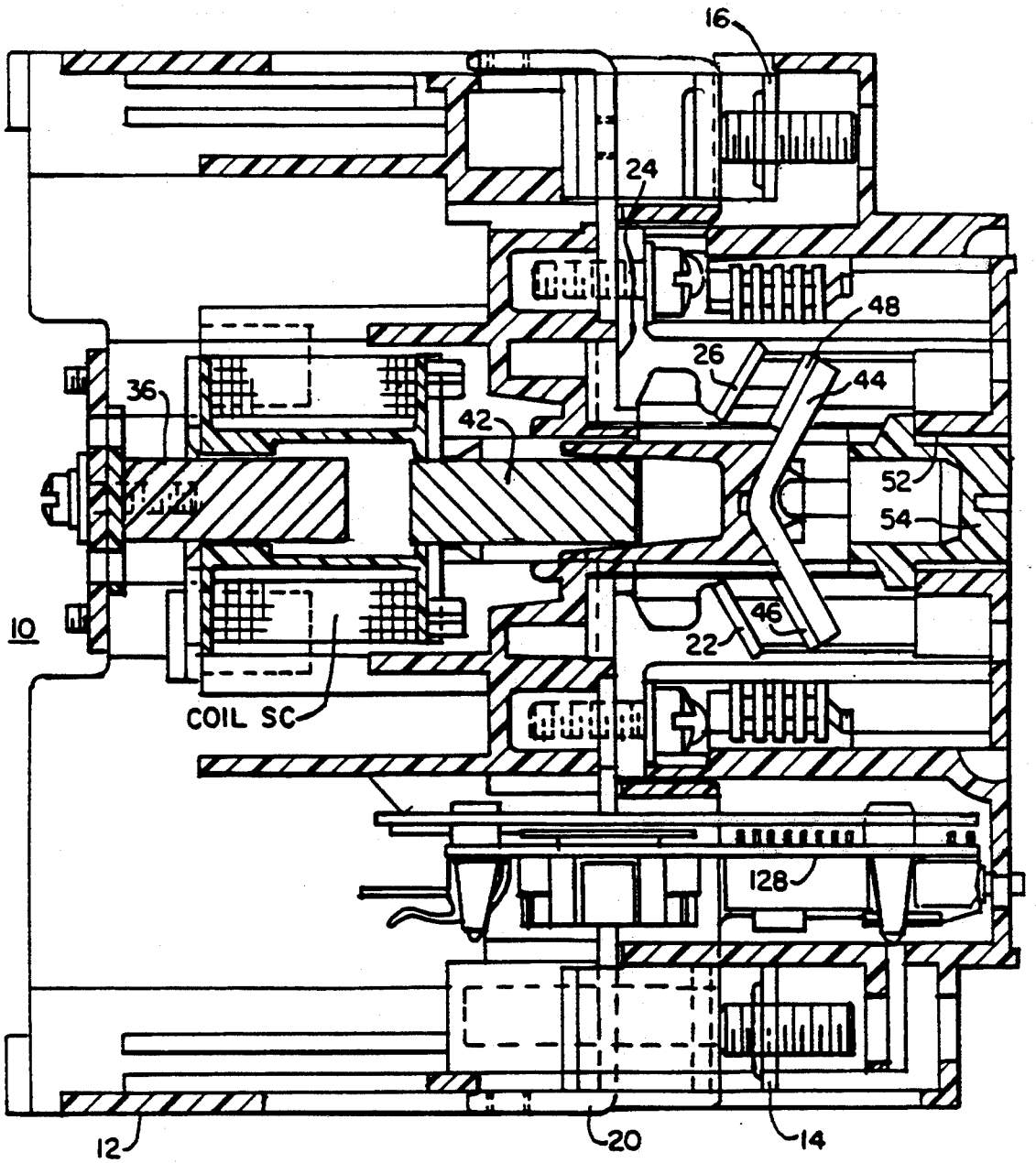
FIG. 1 is a vertical cross-section through one phase of a three-phase contactor to which the invention is applied.

A complete description of a load controller such as a motor starter to which the present invention is applied is provided in the above identified related application which is hereby incorporated by reference. The same reference characters will be used in this application to identify elements common with those in the related application.

Referring to FIG. 1, the motor starter 10 has an insulated housing 12. A pair of spaced apart terminals 14, 16 for each phase (only one phase shown) are provided for connecting an electrical load, such as a motor winding which is to be controlled by the motor starter device 10, to a power source. Terminal 14 is interconnected with an internal conductor 20 leading to a fixed contact 22 while terminal 16 is interconnected with an internal conductor 24 connected to a fixed contact 26. A contact carrier 42 supports an electrically conductive contact bridge 44 having movable contacts 46, 48 at opposite ends which are complimentary with the fixed contacts 22, 26, respectively.

Movement of the contact carrier 42 and therefore the contact bridge and moveable contacts 46, 48 is effected by a magnet 36 having a coil SC. The coil SC is in turn controlled by a circuit board 128 to be described in detail below. The carrier 42 is spring biased to the position shown in FIG. 1 in which the contact pairs 22, 46 and 26, 48 are opened to interrupt the circuit between terminals 14 and 16. When the coil SC is energized, the carrier 42 is pulled down against the magnet 36 to close the contact pairs 22, 46 and 26, 48 thus completing a circuit to energize the load, such as a motor winding (not shown) connected to the motor starter 10.

Figure 2A:
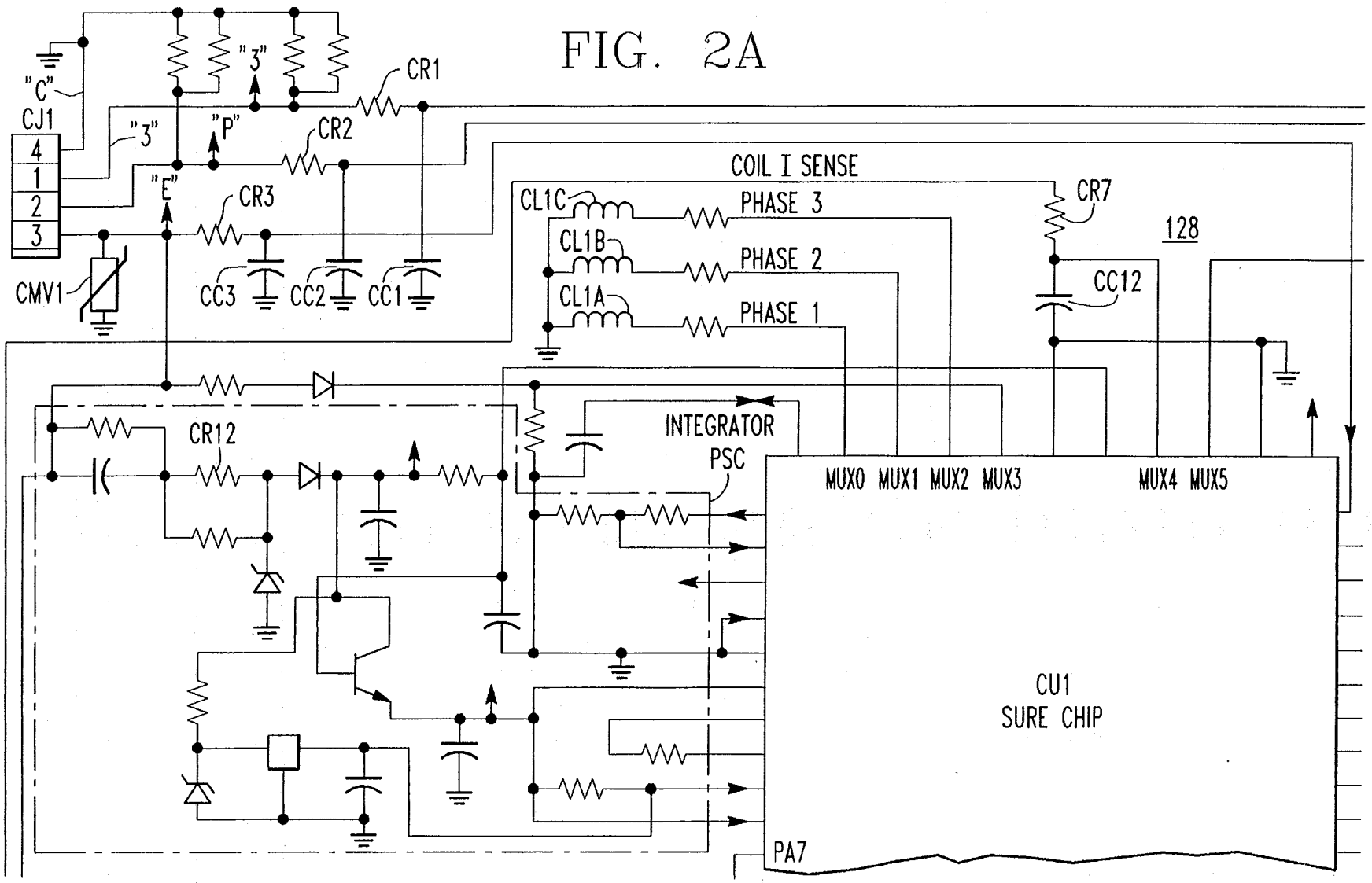
FIGS. 2A–2C illustrate a block diagram of the control system used to control the contactor coil of the contactor of FIG. 1.
Figure 2B:
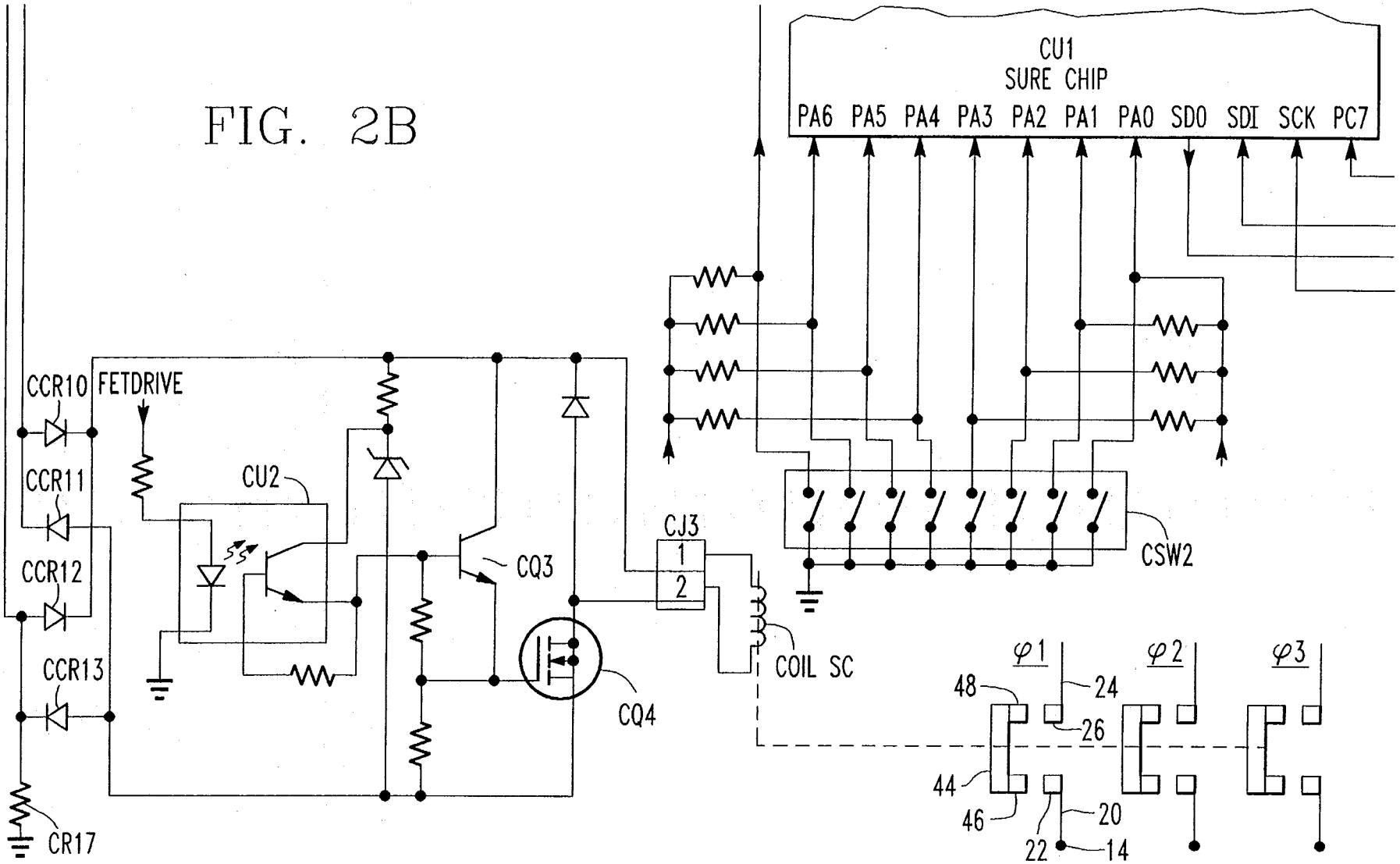
Figure 2C:
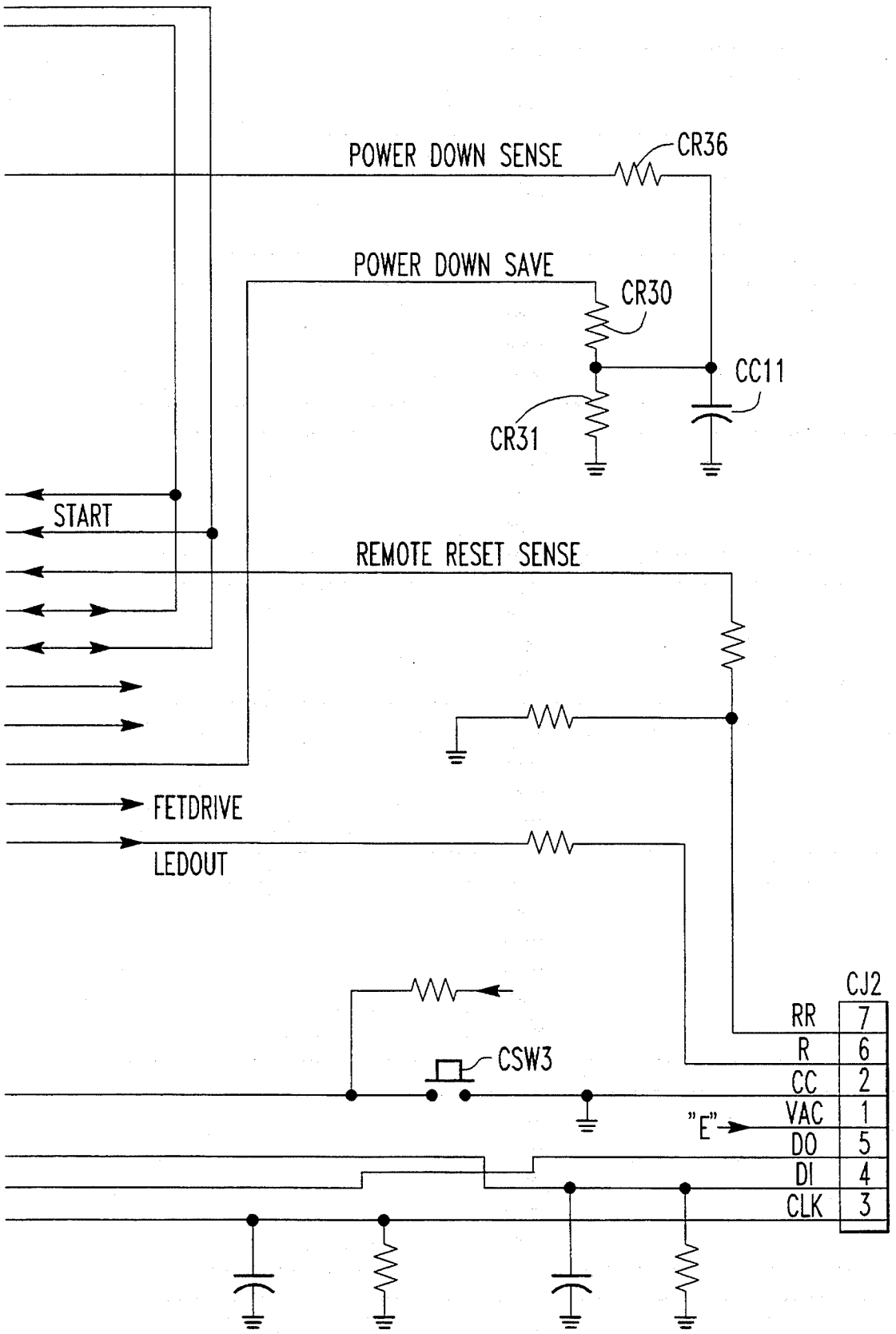

FIGS. 2A–2C together illustrate a schematic circuit diagram for the control board 128 which controls operation of the motor starter coil SC. The heart of the control circuit 128 is a microprocessor provided on the integrated circuit chip CU1. A suitable microprocessor chip CU1 is the "Sure Chip" which is disclosed in more detail in the above cross-referenced application which has been incorporated by reference. The chip CU1 includes a multiplexer, in addition to the processor, memory, and analog and digital input and output interfaces.

Returning to FIG. 2A, four inputs labeled 1–4, are provided on an input connector CJ1. Terminal 4 is connected to system common or ground and is designated the "C" input. Terminal 1 of the connector CJ1 inputs a start signal which is identified as "3" and is applied to the chip CU1 to start the motor. Terminal 2 of the connector CJ1 provides a permit signal "P" which must be present in order for the motor to run. Terminal 3 of the connector CJ1 receives the 120 volt line voltage which is designated as the signal "E". This line voltage signal "E" provides power for operation of the microprocessor CU1 and for energization of the contactor coil SC, as well as providing a timing signal for the microprocessor to gate portions of the line current to the contactor coil SC. The signals "3", "P", and "E", are passed through low pass filters formed by the resistors CR1–CR3 and capacitors CC1–CC3 before being applied to the chip CU1. A varistor CMV1 protects the circuit from surges in the line voltage.

A power supply circuit PSC fed by the line voltage signal "E" provides regulated voltages for the chip CU1. Current transformers CL1A, CL1B and CL1C monitor the three-phase load current for input to the chip CU1 through multiplexer inputs MUX0–MUX2. The system voltage as represented by the "E" signal is input through multiplexer input MUX3.

The ac line signal "E" is rectified by the bridge circuit formed by the diodes CCR10–CCR13 to generate dc current for energizing the contactor coil SC. Energization of the coil SC by the dc current is controlled by a FET, CQ4. The FET CQ4 in turn is controlled by a FETDRIVE signal generated by the chip CU1. The FETDRIVE signal is isolated from the power circuit by an opto-isolator chip CU2. A transistor CQ3 forms with the photo diode of the opto-isolator CU2, a Darlington circuit which controls turn-on of the FET CQ4. The FETDRIVE signal is a pulse signal synchronized by the chip CU1 to the cycles of the line current to input the required amount of energy to close the contactor, and at a reduced level of energization to maintain the contactor closed. A measure of the coil current, detected as the voltage across resistor CR17, is fed back to the chip CU1 as the "COIL I SENSE" signal which is applied to the MUX4 multiplexer input of the chip CU1 through a low pass filter formed by the resistor CR7 and capacitor CC12.

The motor starter 10 provides overload protection for the motor connected to the starter. A set of dip switches CSW2 provides for selection of the rated current for the motor being controlled through the inputs PA1–PA6 of the chip CU1. The dip switches also provide for selection of two trip delays through inputs PA0 and PA7.

Turning to FIG. 2C, an external capacitor CC11 stores a motor heat profile characteristic value generated by the chip CU1. This value is applied to the capacitor CC11 through the port PC4 and resistor CR30. The value of the heat profile characteristic stored in the capacitor CC11 decays by discharge through a resistor CR31 at a rate which mimics the cooling of a motor controlled by the starter 10 when power has been removed from the circuit board 128.

The charge stored on the capacitor CC11 is read by the chip CU1 through the multiplexer input MUX5 which is connected to the capacitor CC11 through the resistor CR36.

The starter 10 can be reset remotely by a signal received through a connector CJ2 and applied to the chip CU1 as a REMOTE RESET SENSE signal. The chip CU1 also generates a LEDOUT signal through the connector CJ2 for energization of an LED on a remote console for indicating the operating mode of the starter. The starter 10 can also be reset locally by activation of the switch CSW3. The microprocessor based motor starter can communicate with, and be controlled by, a remote station through a serial data input port SDI and a serial data output port SDO synchronized by a clock signal which is input through port SCK. The remote clock signal and the serial data input and output signals are connected to the remote system through terminals on the connector CJ2.

The microprocessor incorporated into the Sure Chip CU1 regulates the pulsed dc current applied to the contactor coil SC through the FETDRIVE signal which controls the FET CQ4. As described in U.S. application Ser. No. 07/636,000 incorproated by reference above, the Sure Chip turns on the FET CQ4 at instants calculated to provide sufficient flux to the coil SC to just bring the contacts 22, 46 and 26, 48 to the closed position without contact bounce. Once the contacts have closed, the FETDRIVE signal is further delayed to phase back the pulses of rectified ac voltage applied to the coil SC. It is desirable to reduce the holding current which maintains the contacts in the closed position as low as possible to reduce energy consumption and heating of the coil SC.

When the contactor is to be opened, the microprocessor incorporated in the Sure Chip SU1 terminates the pulses of the FETDRIVE signal which controls the FET CQ4 gating pulsed dc current to the contactor coil SC. As the pulses end with the zero crossings of the supply voltage "E", the point in the ac wave form from at which energization of the coil SC is terminated is constant. Since as discussed above, all the other variables involved in contactor opening are essentially constant, the time for contactor opening is also constant. As also discussed above, this can lead to uneven contactor wear, as the same phase will interrupt the current first and receive less wear than the other two phases which always terminate the current flow. It will also lead to more rapid wear if the contacts are always opening on only positive or negative cycles due to the transfer of material in one direction as discussed above.

In accordance with the invention, the Sure Chip CU1 is provided with a routine which adjusts the point at which the contactor separable contacts open to distribute contactor openings over the three phases of contactors to promote more even contact wear. This is accomplished by adjusting the delay angle of the final holding pulse in the FETDRIVE signal generated by the Sure Chip CU1. By shortening the delay angle, more energy is put into the coil SC during the last pulse, and therefore, it will taken longer for the coil current to decay to the point where the kickout spring is strong enough to overcome the flux holding the contactor closed. One approach is to randomly vary the delay angle, so that over time each one of the three phases is the first to interrupt current.

In the preferred embodiment of the invention, distribution of contactor wear is more deterministic. According to this embodiment of the invention, the delay angle of the final pulse is adjusted on consecutive contactor openings so as to fix the sequence in which the different phases are the first to interrupt current. The invention also assures that each phase interrupts current flowing in each direction an equal number of times to average out the transfer of material in the direction determined by polarity. Thus, in accordance with the invention, for each six consecutive contactor openings, gating of the FETDRIVE pulses to the FET CQ4 is adjusted to assure that each phase is the first to open with the current flowing in each direction. As the adjustment available from a single half cycle is not sufficient to distribute contact opening over all three phases with current flowing in each direction, the invention provides for alternating between positive and negative half cycles of the control voltage for gating the last pulse to the coil SC in order to assure current interruption during positive and negative half cycles. The delay angle of the selected last pulse is then varied to distribute the positive or negative opening over the three phases.

Figure 3:
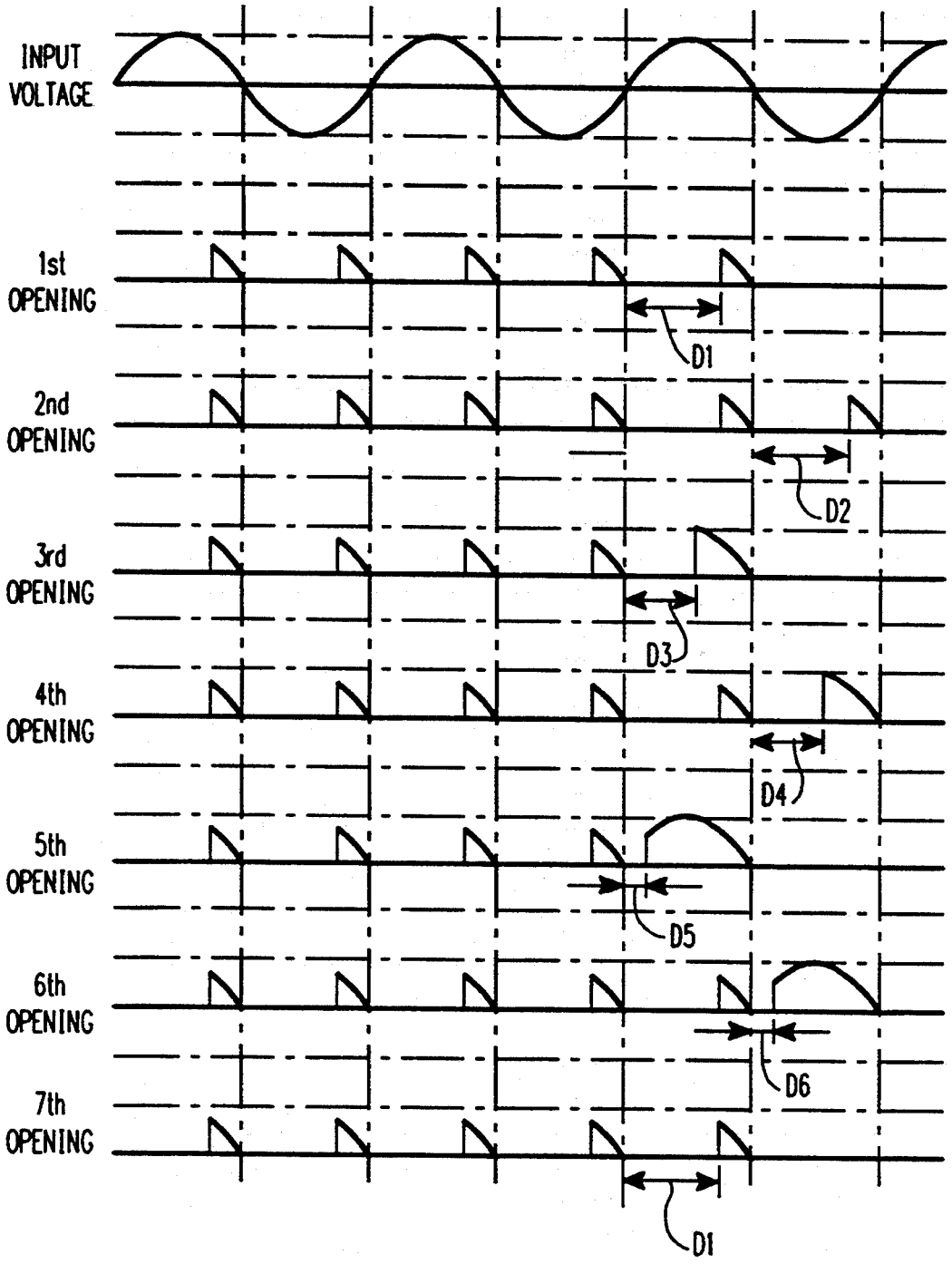
FIG. 3 is a wave form diagram illustrating the input voltage to the control system of FIG. 2 and the energizing pulses generated by that control system in controlling the contactor in accordance with the invention.

FIG. 3 illustrates this aspect of the invention. One sequence for distribution of contact opening comprises selecting the delay angles so that one phase, for instance, phase a, is the first to open. This delay is applied first to a positive half cycle for providing the last pulse to the coil SC followed by applying the same delay to a negative half cycle of the supply voltage. In this manner, the same phase is the first to open, first with current in one direction and then with current in the opposite direction. The delay angle is then increased by an amount which causes the opening of the contacts to be delayed until another phase is the first to interrupt current. This second delay is then applied sequentially to a positive and negative last pulse to effect alternation of the polarity of the current interrupted by this second phase. In a like manner, the delay angle is then increased again and applied to positive and negative last half cycles to cause the third phase to be the first to open with both polarities. Thus, as shown in FIG. 3, the first opening with a long delay $D_1$, is applied to a positive half cycle to provide the last pulse to the coil SC. The next time the contactors open, the delay $D_2$ of the same said duration as $D_1$, is applied to a negative half cycle. For the third opening, the delay $D_3$ is made shorter than $D_1$ and $D_2$ and applied to the positive half cycle. A delay $D_4$ of the same duration as then applied to the negative half cycle for the fourth opening. For the fifth and sixth openings, delays $D_5$ and $D_6$, of equal duration longer than $D_3$, are applied to positive and negative half cycles. Beginning with the seventh opening, the pattern is repeated with the delay $D_1$ applied to a positive half cycle.

Figure 4:
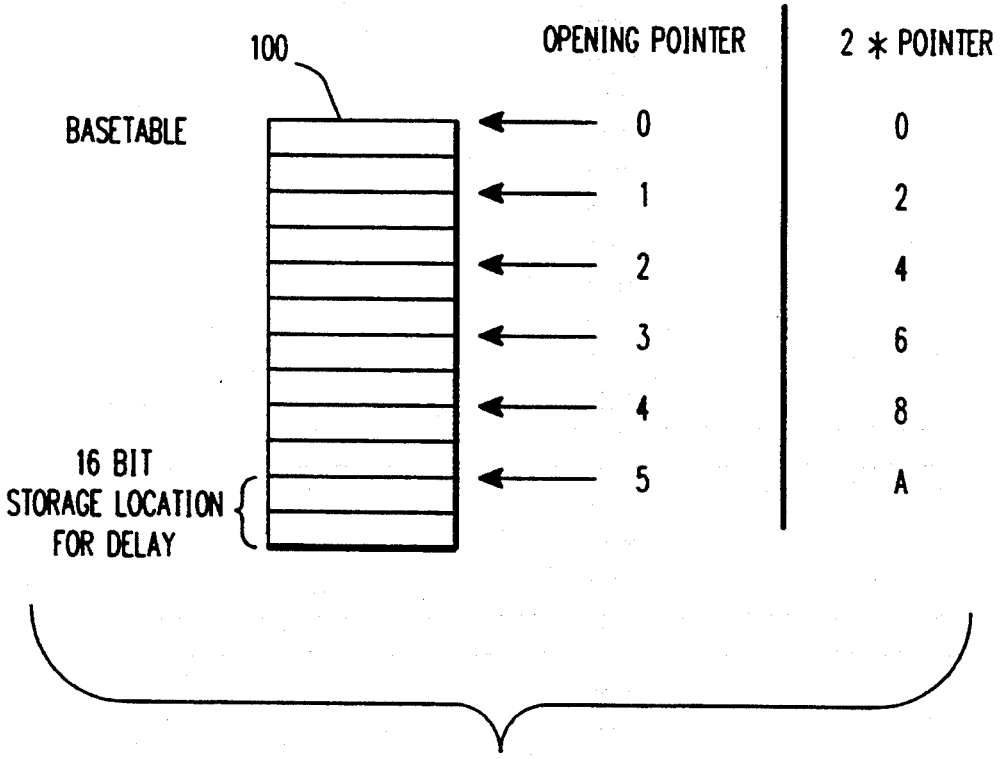
FIG. 4 illustrates the manner in which data used by the control system of FIG. 2 in carrying out the invention is stored in and retrieved from a memory which forms part of the control system.

The delays $D_1$–$D_6$ can be determined empirically and their values are stored in memory 100 as shown in FIG. 4 beginning with an address which can be labeled BASETABLE. In the exemplary system, 16 bit delays are each stored in two bytes in the memory 100. An opening pointer indexes through the delays with each opening. The absolute address is determined by multiplying the pointer number by two and adding the product to the base address of the table.

Figure 3A:
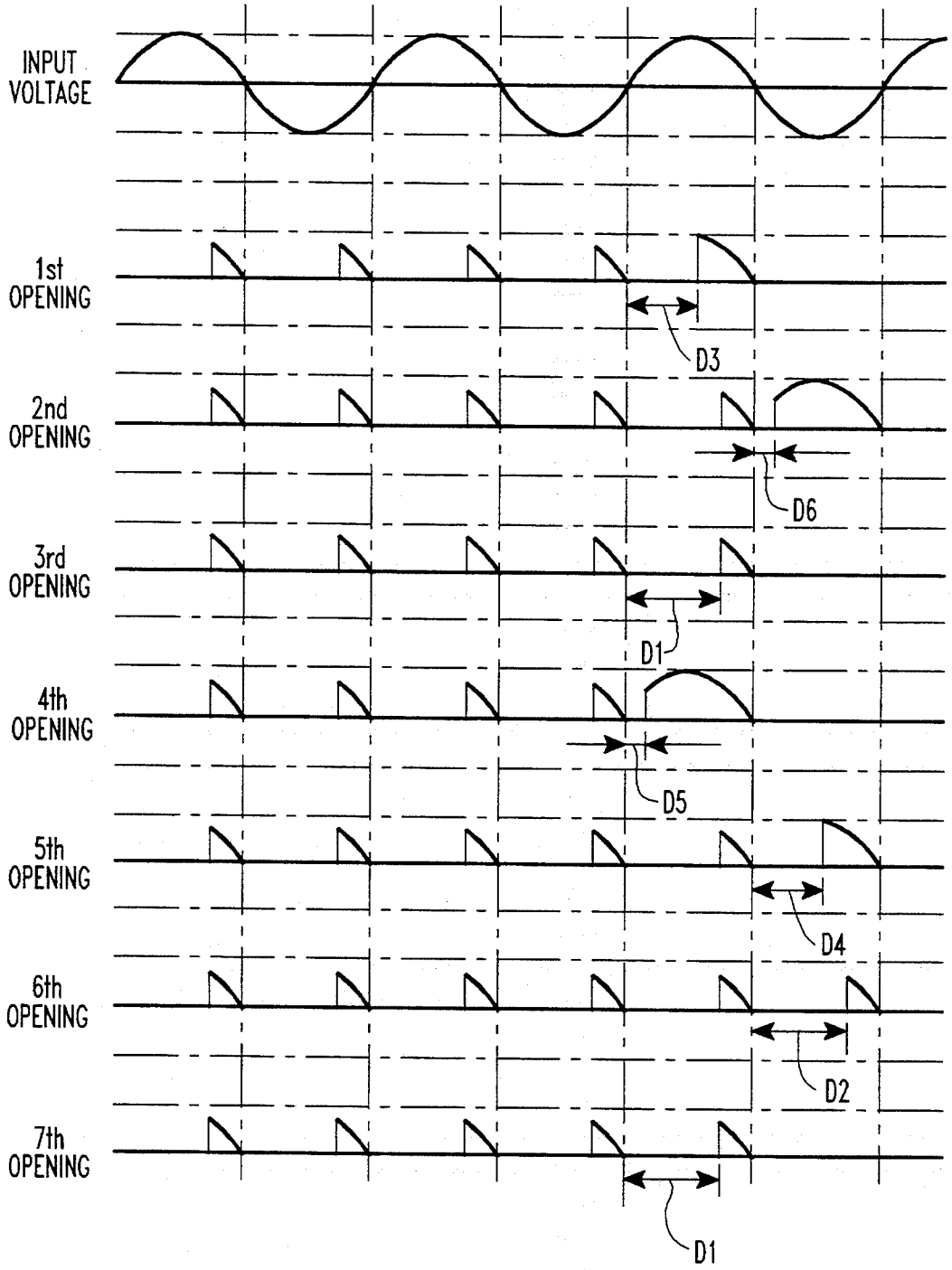
FIG. 3A is a wave form diagram illustrating the input voltage of the control system of FIG. 2, similar to that shown in FIG. 3, and the energizing pulses generated by that control system and controlling the contactor in accordance with the invention where the energizing pulses are generated in a random manner.

FIG. 3A illustrates an aspect of the invention wherein the control pulses are generated in a random manner. For purposes of simplicity of illustration the same time delayed pulses shown in FIG. 3 are depicted once again in FIG. 3A. However, the order of the gating of those pulses to the control system is different reflecting the random nature of the embodiment of the invention related to FIG. 3A. Furthermore, it is to be understood that the pulses may continue to be generated in a random fashion after the seventh opening shown in FIG. 3

A with none of the pulses having the same time delays shown in FIG. 3A. It is envisioned by the very nature of this embodiment of the invention that many different time delays, none of which are the same may be utilized over a large number of cycles in order to statistically insure that all three phases are substantially, equally, given an opportunity to be the first to interrupt current during an interrupting operation and further to insure that the exact time of interruption is spread out over the entire input voltage cycle.

Figure 5:
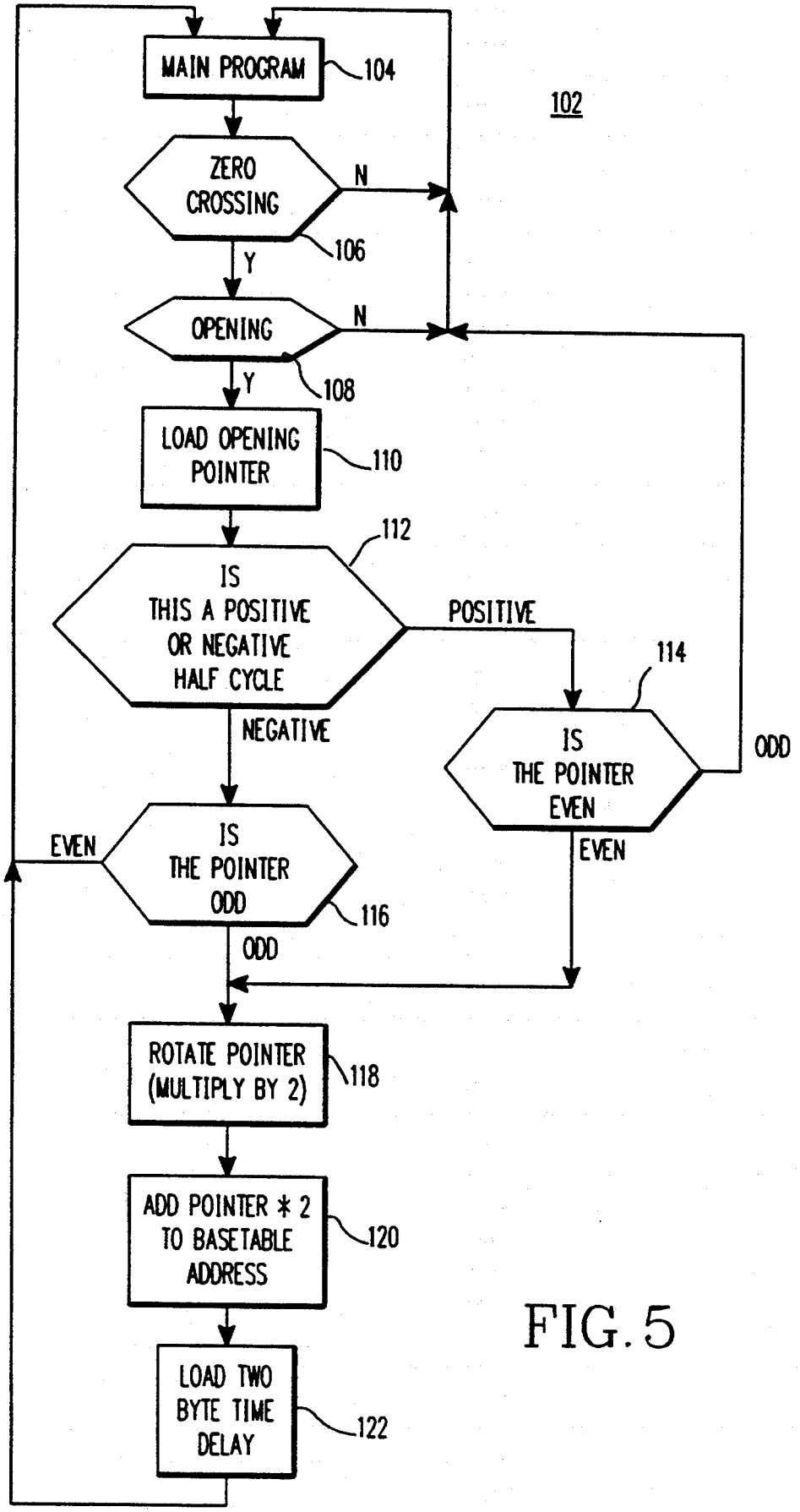
FIG. 5 illustrates a flow chart of a suitable computer program run by the control system of FIG. 2 in carrying out the invention.

FIG. 5 presents a flow chart of a suitable computer program 102 for implementing the invention. The microprocessor in the Sure Chip CU1 executes a main program at 104 to generate the FETDRIVE signal to close and maintain the contactor in a closed position. When a signal is generated to open the contactor, the routine 102 is run. This routine checks for zero crossings of the control voltage at 106. When a zero crossing is detected, if a command has been generated to open the contactor as determined at 108, the opening pointer indicating the location of memory of the delay for the next opening is loaded at 110. A determination is then made at 112 whether the current half cycle of the control voltage is positive or negative. If it is positive and the pointer which was just loaded is odd, as determined at 114, the routine loops back to the main program and waits for the negative half cycle. Thus, on the subsequent half cycle, the negative half cycle of the control voltage will be detected at 112. Since the pointer is odd as detected at 116, the pointer is rotated at 118 by multiplying by two, and the product is added to the BASE-TABLE address at 120 to determine the address of the delay which is loaded at 122. During a positive half cycle, as determined at 112 if the pointer is even as determined at 114, then the pointer is similarly rotated at 118 with the product added to the base address at 120, and the two byte delay at that address is loaded at 122. The main program then applies these selected delay in determining the delay angle for the last pulse. This routine 102 produces the exemplary pattern illustrated by the wave forms of FIG. 3.

With this invention, the wear on the separable contacts in the three phases of the contactor are evenly distributed and the openings of each contact pair alternate in polarity of the interrupted current.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A three phase electrical contactor having separable contacts for each phase, an electromagnet coil controlling opening and closing of said separable contacts to control a flow of load current therethrough, solid-state coil energizing means gating pulses of dc voltage to said electromagnet coil to close said separable contacts and terminating gating pulses of dc voltage to said electromagnet coil to open said separable contacts, said coil energizing means including adjusting means which varies on consecutive openings of said separable contacts a phase of said separable contacts which is first to interrupt said flow of load current to thereby evenly distribute wear over said separable contacts for each phase.

2. The electrical contactor of claim 1 wherein said solid-state coil energizing means has means rectifying an ac voltage to generate said pulses of dc voltage, and wherein said adjusting means sequentially varies a point in said ac voltage at which said separable contacts open on consecutive openings in a preselected pattern.

3. The electrical contactor of claim 2 wherein said adjusting means includes means adjusting said point in said ac voltage to include points during both positive and negative half cycles of said ac voltage.

4. The electrical contactor of claim 2 wherein said adjusting means sequentially adjusts said point in said ac voltage at which said separable contacts open for six consecutive openings to make said separable contacts for each phase first to interrupt current once during a positive half cycle of said ac voltage and once during a negative half cycle of said ac voltage.

5. The electrical contactor of claim 4 wherein said adjusting means adjusts said point in said ac voltage at which said separable contacts open to alternate between positive and negative half cycles of said ac voltage.

6. The electrical contactor of claim 1 wherein said solid-state coil energizing means has means rectifying an ac voltage to generate said pulses of dc voltage, wherein said coil energizing means controls a delay angle of rectified pulses gated to said electromagnet coil, and wherein said adjusting means adjusts said delay angle of a final pulse gated to said electromagnet coil to adjust said point in said ac voltage at which said electromagnet coil opens said separable contacts.

7. The electrical contactor of claim 6 wherein said adjusting means also adjusts said final pulse between positive and negative half cycles of said ac voltage.

8. The electrical contactor of claim 7 wherein said adjusting means adjusts said delay angle so that in each six consecutive openings of said separable contacts, said separable contacts for each phase are first to interrupt current once during a positive half cycle of load current and once during a negative half cycle of load current.

9. A three phase electrical contactor having separable contacts for each phase, comprising: an electromagnetic coil controlling opening and closing of said separable contacts to control a flow of load current therethrough, solid-state coil energizing means gating pulses of dc voltage to said electromagnetic coil to close said separable contacts and terminating gating pulses of dc voltage to said electromagnetic coil to open said separable contacts, said coil energizing means including adjusting means which selects on consecutive openings of said separable contacts a phase which is first to interrupt said flow of load current to thereby evenly distribute wear over said separable contacts for each phase; wherein said solid-state coil energizing means has means rectifying an ac voltage to generate said pulses of dc voltage and wherein said adjusting means randomly adjusts point in said ac voltage at which said separable contacts open to thus select the set of separable contacts which is first to open.

10. The electrical contactor of claim 9 wherein said adjusting means randomly adjusts within about a cycle of said ac voltage said point in said ac voltage at which said separable contacts open.

11. An electrical contactor having separable contacts, comprising: an electromagnetic coil controlling opening and closing of said separable contacts to control the flow of current therethrough, solid-state coil energizing means gating pulses of dc voltage to said electromagnet coil to close said separable contacts, and terminating gating pulses of dc voltage to said electromagnet coil to open said separable contacts, said coil energizing means including means rectifying an ac voltage to generate said pulses of dc voltage and also including adjusting means adjusting a point in said ac voltage at which said separable contacts open so that over time said separable contacts open substantially an equal number of times during positive and negative half cycles; wherein said coil energizing means controls a delay angle of rectified pulses gated to said electromagnet coil, and wherein said adjusting means adjusts said delay angle of a final pulse gated to said electromagnetic coil to adjust said point in said ac voltage at which said electromagnet coil opens said separable contacts.

12. The electrical contactor of claim 11 wherein said adjusting means sequentially adjusts said point in said ac voltage at which said separable contacts open in a predetermined selected pattern.

13. The electrical contactor of claim 11 wherein said adjusting means randomly adjusts within about a cycle of said ac voltage said point in said ac voltage at which said separable contacts open.

* * * * *